US007802845B2

(12) United States Patent
Kelleher

(10) Patent No.: US 7,802,845 B2
(45) Date of Patent: Sep. 28, 2010

(54) SEAT CADDY HAVING REAR BENCH-ENGAGING MEMBERS

(75) Inventor: Kevin Kelleher, Kirkland, WA (US)

(73) Assignee: KB Creations, Kirkland, WA (US)

( * ) Notice: Subject to any disclaimer, the term of this patent is extended or adjusted under 35 U.S.C. 154(b) by 0 days.

(21) Appl. No.: 11/861,483

(22) Filed: Sep. 26, 2007

(65) Prior Publication Data

US 2009/0079244 A1 Mar. 26, 2009

(51) Int. Cl.
*A47C 1/16* (2006.01)

(52) U.S. Cl. ..... 297/252

(58) Field of Classification Search ..... 297/250.1, 297/252, 188.01, 188.06
See application file for complete search history.

(56) References Cited

U.S. PATENT DOCUMENTS

| | | | | | |
|---|---|---|---|---|---|
| 2,736,365 | A | * | 2/1956 | Hines | 297/183.5 |
| 2,792,875 | A | * | 5/1957 | Pirrone | 297/252 |
| 2,865,433 | A | * | 12/1958 | Warner | 383/25 |
| 3,120,404 | A | * | 2/1964 | Bramming | 297/118 |
| 3,594,039 | A | * | 7/1971 | Harp | 297/252 |
| 3,763,972 | A | * | 10/1973 | Karzmar | 190/8 |
| 4,597,605 | A | * | 7/1986 | Gilbert | 297/228.1 |
| 4,842,329 | A | * | 6/1989 | Owens | 297/3 |
| 4,854,637 | A | * | 8/1989 | McCree | 297/188.2 |
| 5,042,875 | A | * | 8/1991 | Biggs, Sr. | 297/252 |
| D357,609 | S | * | 4/1995 | Webb et al. | D6/596 |
| 5,421,637 | A | * | 6/1995 | Lemburg | 297/188.01 |
| 5,516,193 | A | * | 5/1996 | Simpson | 297/252 |
| 5,573,288 | A | * | 11/1996 | Raffensperger | 297/188.12 |
| 5,641,199 | A | | 6/1997 | Bond-Madsen | |
| 5,816,463 | A | * | 10/1998 | Echeverri | 224/584 |
| D413,733 | S | * | 9/1999 | Edmonds | D6/336 |
| 6,082,816 | A | * | 7/2000 | Gottlieb et al. | 297/188.1 |
| 6,592,187 | B2 | | 7/2003 | Calvery | |
| D494,770 | S | * | 8/2004 | Hillard | D6/368 |
| 6,848,746 | B2 | * | 2/2005 | Gentry | 297/380 |
| 6,926,360 | B2 | | 8/2005 | Jones | |
| 6,935,686 | B1 | * | 8/2005 | Liao | 297/252 |
| 2004/0155506 | A1 | * | 8/2004 | Gentry | 297/380 |

FOREIGN PATENT DOCUMENTS

| | | |
|---|---|---|
| JP | 3126405 | 5/1995 |
| JP | 9294651 | 11/1997 |

OTHER PUBLICATIONS

International Search Report, for International Application No. PCT/US2007/079568, Korean Intellectual Property Office, Jun. 18, 2008.

* cited by examiner

*Primary Examiner*—Joseph F Edell
(74) *Attorney, Agent, or Firm*—Kevin D. Jablonski; Graybeal Jackson LLP

(57) ABSTRACT

A seat caddy having at least one rear member suitable to engage a bench. According to one embodiment of the subject matter disclosed herein, typically two bench-engaging members are rotatably attached to the bottom rear of a seat cushion such that when rotated into an engagement position, the bench-engaging members may secure the seat cushion from moving, sliding or rotating away from an optimal bench position. Further, a storage bag may be removably attached to the bottom front of the seat cushion, such that the storage bag hangs from the front of the seat cushion and provides an additional securing force for maintaining the seat caddy position when engaged with a seat.

15 Claims, 4 Drawing Sheets

SEAT CADDY HAVING REAR BENCH-ENGAGING MEMBERS

BACKGROUND

Many people enjoy going to sporting events and concerts in stadium and event centers that have stadium seating, bench seating, bleacher seating, and the like. These types of seats in these stadiums and event centers offer much versatility for the facility with regard to cleaning and maintenance. However, with this versatility other seat amenities, such as seat cushioning and storage are sacrificed. As a result, many attachable seat cushions are available to the consumer to provide additional seat comfort and functionality in a removable and portable seat apparatus.

FIG. 1 shows an isometric view of a conventional seat cushion 100 having several different adjustment points 101-104 for attaching the seat cushion to a seat or chair. The conventional seat cushion 100 is typically designed to fit over a seat, e.g., a stadium seat and the like, such that each adjustment point may be adjusted individually to fit more securely with the contour of whatever seat the seat cushion 100 is attached to. Thus, as a person slips the conventional seat cushion 100 over a stadium seat for example, the individual must then adjust each of the four latch and strap combinations 101-104 in order to get the seat adjusted to fit more securely on the stadium seat.

Several problems are typically encountered when using the conventional seat cushion 100 of FIG. 1. First, when initially setting the seat cushion 100 to a typical stadium seat or lawn chair, each of the four adjustment points 101-104 must typically be adjusted separately as the latch and strap system depicted is not easily manipulated with a single hand. Even if an individual with extraordinary dexterity were able to manipulate one latch and strap system 101 with one hand, this still leaves only one other hand free for one of the other three latch and strap adjustment points 102-104.

Furthermore, once the conventional seat cushion 100 is in place, adjusting the fit of the seat cushion 100 to the stadium seat also typically requires adjusting each of the four adjustment points 101-104. Similarly, when removing the seat cushion 100 from the stadium seat, once again, each of the four adjustment points 101-104 must typically be adjusted or released in order to more easily remove the conventional seat cushion 100 from the engaged stadium seat.

Another problem with the conventional seat cushion 100 of FIG. 1 is that having four adjustment points 101-104 prevents use with a standard bleacher or bench seating. This conventional seat cushion 100 shows the four adjustment points 101-104 as being detachable (i.e., clasps) which be disengaged and re-engaged around a bleacher seat. However, some conventional seat cushions (not shown) do not have detachable adjustment points 101-104. Furthermore, the same multi-faceted adjustment process must still take place when engaging a bleacher.

Further yet, Even if one were to simply remove the bottom portion of the seat cushion 100 and simply rest the top portion on a bleacher or bench, the seat cushion remains prone to slipping and sliding about while in use and there are no members or protrusions from the seat cushion to engage the bench or bleacher. That is, with the bottom of the seat cushion being a flat surface, the seat cushion 100 is free to move about with minimal force as nothing engages the bench upon which it is resting.

As such, having several adjustment points results in a more time-consuming and burdensome manipulation when engaging or disengaging the conventional seat cushion 100 of FIG. 1. Additionally, the conventional seat cushion 100 of FIG. 1 is prone to slipping and sliding about a bench or bleacher because there is no way to firmly engage the bench or bleacher.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

The following discussion is presented to enable a person skilled in the art to make and use one or more inventions disclosed herein. The general principles described herein may be applied to embodiments and applications other than those detailed above without departing from the spirit and scope of the present subject matter. The present disclosure is not intended to be limited to the embodiments shown, but is to be accorded the widest scope consistent with the principles and features disclosed or suggested herein.

Figure 1:
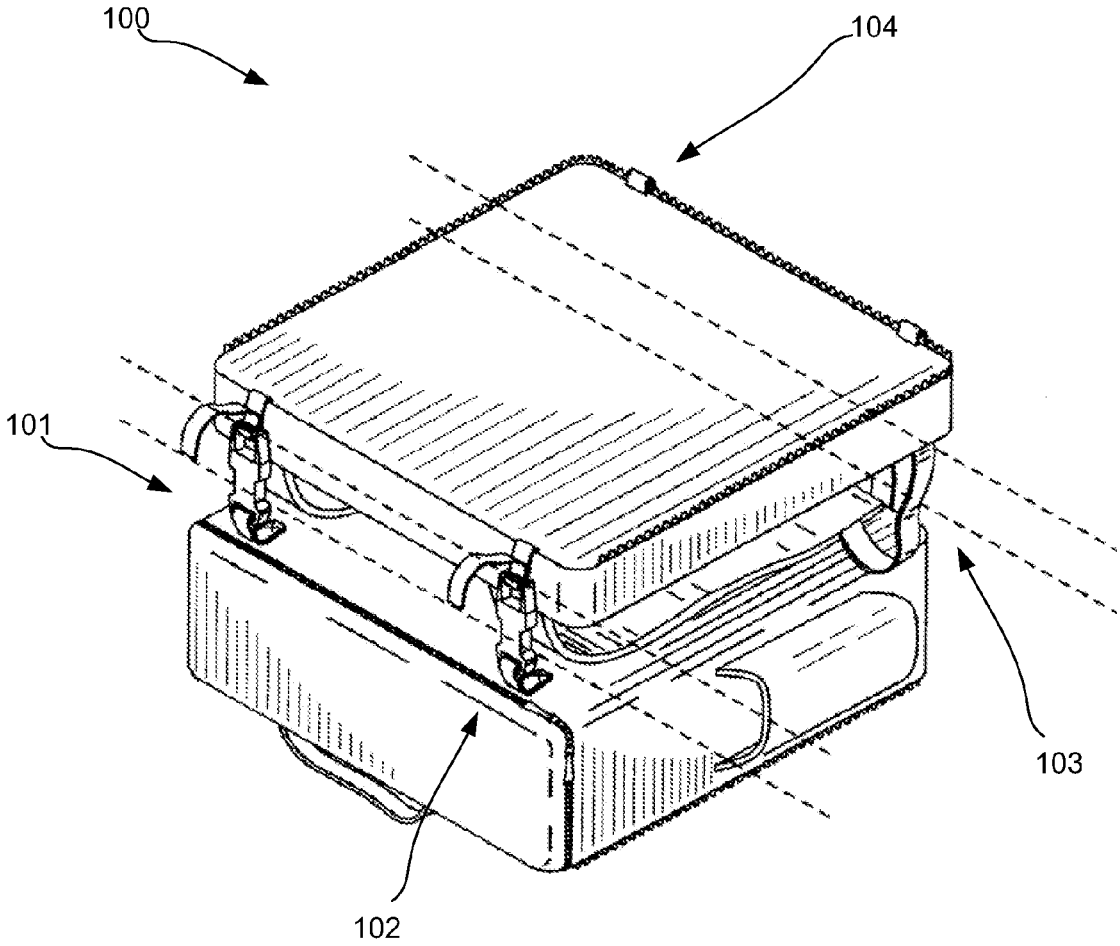
FIG. 1 (PRIOR ART)
FIG. 1 is an isometric view of a conventional seat cushion having a conventional latch and strap system with several adjustment points.
Figure 2:
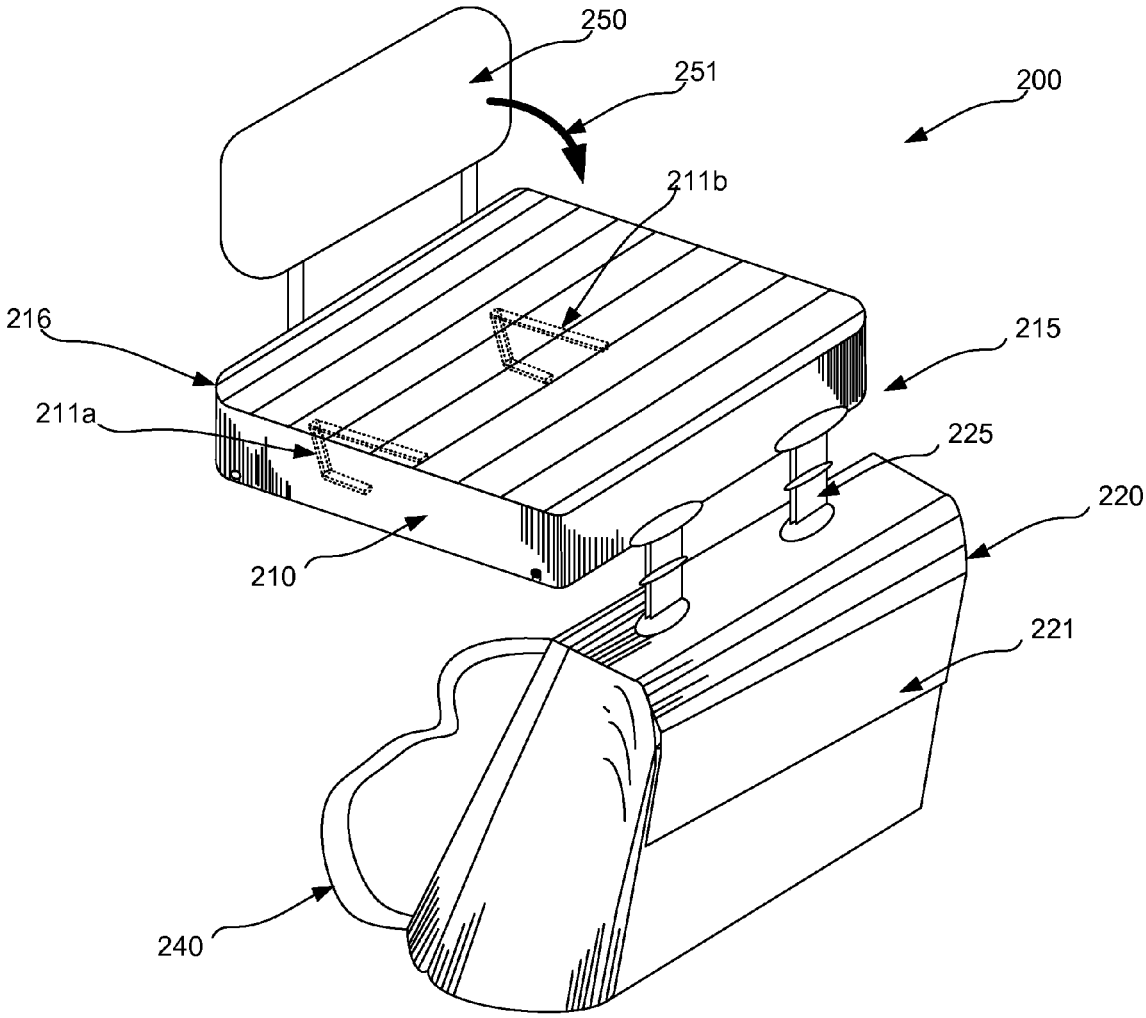
FIG. 2 is an top-side isometric view of a seat caddy having bench-engaging members rotatably attached to the bottom rear side of the seat caddy and showing an attached storage bag according to an embodiment of the subject matter disclosed herein.

FIG. 2 is a top-side isometric view of a seat caddy 200 having bench engaging members 211*a* and 211*b* rotatably attached to the bottom rear side of the seat and showing an attached storage bag 220 according to an embodiment of the subject matter disclosed herein. In this embodiment, the seat caddy 200 comprises a top portion 210 operable to engage a bench (not shown in FIG. 2). The top portion 210 may be characterized by a front side 215 and a rear side 216 such that when engaged with the bench, the front side 215 aligns with a front side of the bench and the rear side 216 aligns with a rear side of the bench.

The seat caddy 200 further includes at least one bench engagement member 211*a* and 211*b* attached to the top portion 210 near the rear side 216 such that the bench engagement member 211*a* or 211*b* engages the bench and prevents the top portion from being able to move away from the bench. That is, as a person sits in the seat, i.e., engages the top portion 210 in a sitting position, and perhaps leans forward creating a moment force at the corner of the underlying bench, the rear bench engaging members 211*a* and 211*b* prevent the top portion 210 from rotating forward. Further, if the person who is sitting stands up, any significant weight in the attached storage bag 220 may also create a force by which the top portion 210 would tend to move or rotate away from the bench. Again, the rear bench engaging members 211*a* and

211*b* advantageously prevent this. As shown is FIG. 2, one can see the outline of two such bench engaging members 211*a* and 211*b*.

Finally, in this embodiment of FIG. 2, the seat caddy 200 includes a storage cavity or storage bag 220 removably attached to the top portion 210 near the front side 215 such that storage cavity 220 hangs from the top portion 210 in front of the bench. Further, the seat caddy 200 may include a seat back 250 that is rotatably and/or removably attached to the rear side 216 of the top portion 210. Such a seat back 250 may rotated down in the direction 251 for storage and transport. When the seat caddy 200 is engaged with a seat, the seat back 250 may be rotated to open position to support the back of a person sitting on the seat caddy 200. In addition, the seat caddy 200 may include a shoulder strap 240 attached to either the top portion 210 or the storage cavity 220 for use during transport. Other attachments for transport, such as a carry bag or backpack are contemplated but not discussed herein for brevity.

Typically, the seat caddy 200 includes a top portion 210 that comprises a cushion surface suitable for seating a human. Such a cushion may be suitable for comfortably sitting upon, such as a cushion made from leather, vinyl, cloth, plastic, composite, fabric, or canvas. In addition, the storage cavity 220 may also comprise material from the same list above as well as having an insulating material.

The storage cavity 220 typically includes a movable flap 221 opening such that the movable flap 221 may be secured in a closed position enclosing the storage cavity 220 and secured in an open position exposing the storage cavity 220. The storage cavity 220 is typically insulated for maintaining a temperature inside the storage cavity 220. That is, when cold items are placed inside the cavity 220 the insulation assists with maintaining a cool temperature and when a heated item is placed in the cavity 220 the insulation assists with maintaining a heated temperature.

The cavity 220 is typically removably attached to the top portion 210 using one or more manipulation devices 225 suitable for adjusting or removing the storage cavity 220. The manipulation device 225 may typically be a push-button latch (such as shown in FIG. 2), a hook and latch attachment, a tie-down, a pressure-ring latch, a snap, or a zip-latch. Other latching or securing mechanisms are contemplated but not described herein for brevity.

The bench engaging members 211*a* and 211*b* are suitable to engage any kind of seat with which the seat caddy 200 may be paired. Such seats include stadium seats, bleacher seats, lawn chairs, camp chairs as well as any typical furniture characterized as a chair. As can be seen in FIG. 2, the bench engaging members 211*a* and 211*b* are shaped like a U-shaped hook with right angles. Such a bench engaging member 211*a* or 211*b* is suitable for interfacing with a bleacher seat that, in turn, has right angles. Other shapes of the bench engaging members 211*a* and 211*b* are contemplated but not discussed herein for brevity.

Each bench engaging member 211*a* and 211*b* may be rotatably attached to the top portion 210 such that the bench engaging member 211*a* and 211*b* is operable to be rotated to a storage position when not engaged with a bench. That is, a storage position for the rear bench engaging members 211*a* and 211*b* typically comprises rotation to a flat position that is parallel with the bottom side of the top portion 210 of the seat caddy. When rotated out for engagement with the bench, each bench engagement member 211*a* and 211*b* is typically at a right angle to the bottom side of the top portion 210 as a shown in FIG. 2.

A typical rear bench engagement member 211*a* or 211*b* is suited to fit a typical bleacher style bench have an effective "hook" range (i.e., engagement width) of about 2 inches. Of course, other typical widths of engagement are also possible such that the rear bench engaging members 211*a* and 211*b* may be fixed to an engagement width of anywhere between 1 inch and 5 inches. Further, in some embodiments, the rear bench engaging members 211*a* and 211*b* may also feature an adjustable engagement width by use of a sliding mechanism or the like. In some embodiments, the rear bench engaging members 211*a* and 211*b* may not necessarily be in place at all as the seat caddy may rely upon the weight of the seated individual to keep the seat caddy engaged with the bench.

Figure 3:
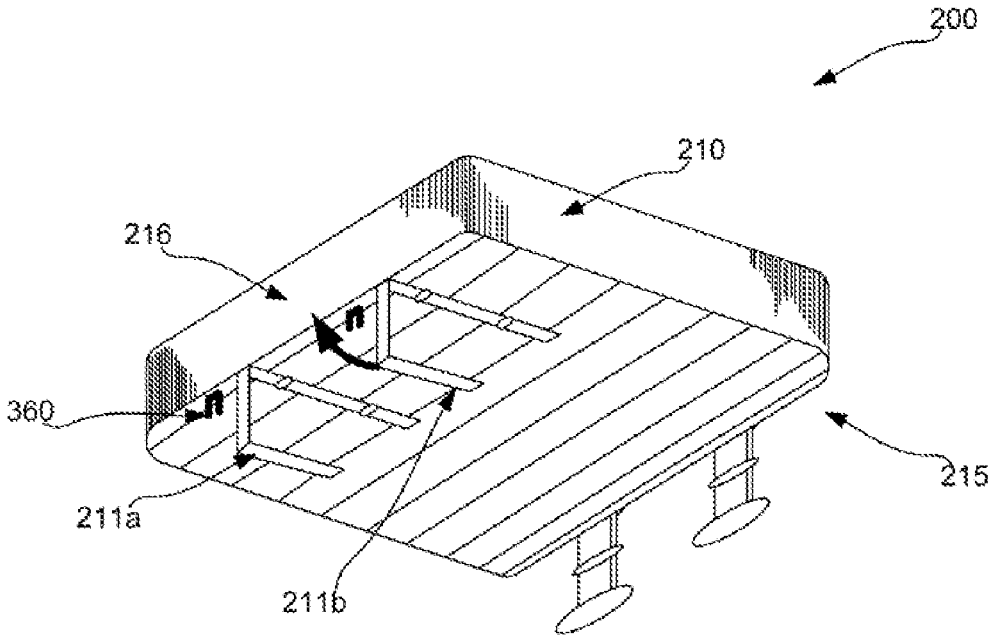
FIG. 3 is an bottom-side isometric view of a seat caddy having bench-engaging members rotatably attached to the bottom rear side of the seat caddy according to an embodiment of the subject matter disclosed herein.

Turning to FIG. 3, a bottom-side isometric view of the seat caddy 200 is shown having bench-engaging members 211*a* and 211*b* rotatably attached to the bottom rear side of the seat caddy according to an embodiment of the subject matter disclosed herein. This view shows more clearly the nature of the rear bench engaging members 211*a* and 211*b*. Further, the seat caddy of FIG. 3, may include a securing mechanism 360 for each bench engaging member 211*a* and 211*b* such that the mechanism 360 may engage the rotatably attached bench-engaging member 211*a* and 211*b* when the bench-engaging member is rotated to a storage position, e.g., rotated in the direction 3 him 61. The securing mechanism 360 may typically be a plastic engagement device suitable for holding the bench engaging member 211*a* and 211*b* securely in place; however any securing mechanism 360 that holds the bench engaging members in a secure position may be used.

Figure 4:
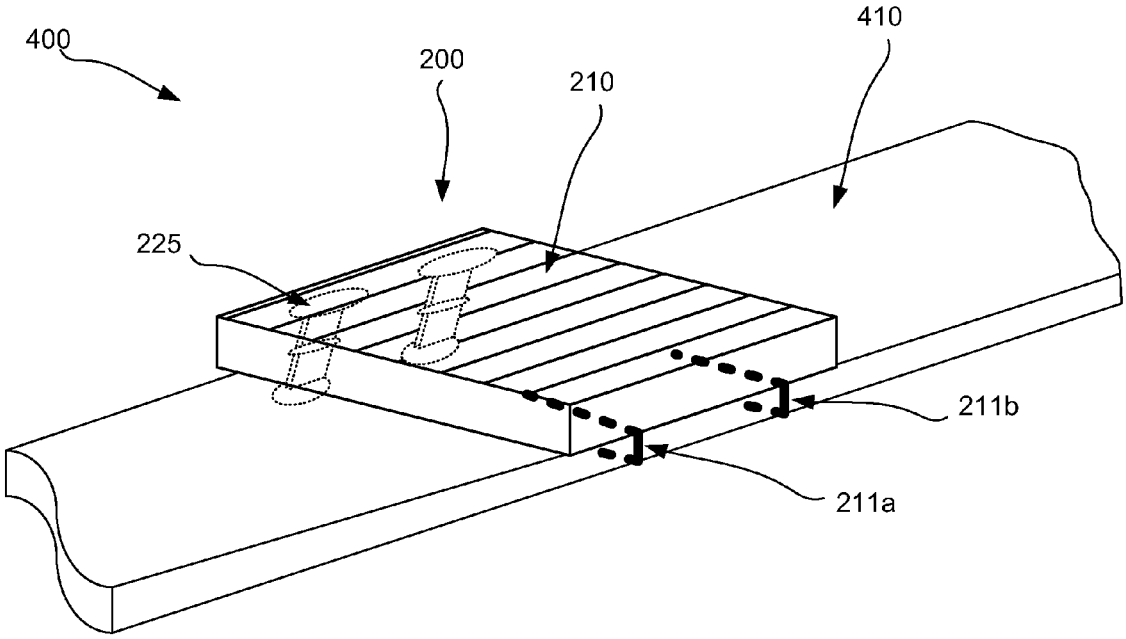
FIG. 4 is an isometric view of a seat caddy having a having bench-engaging members rotatably attached to the bottom rear side of the seat caddy engaged with a typical bleacher style seat according to an embodiment of the subject matter disclosed herein.

FIG. 4 is an isometric view of an apparatus that includes a seat caddy 200 having a having bench-engaging 211*a* and 211*b* members rotatably attached to the bottom rear side of the seat caddy engaged with a typical bleacher style seat 410 according to an embodiment of the subject matter disclosed herein. At least one embodiment of the subject matter discussed herein includes a method for attaching the seat caddy 200 to a seat. The method includes engaging a seat caddy 200 with a seat, such that a top portion 210 of the seat caddy 200 rests on the seat 410. The cavity portion (not shown for clarity) is supported by an attachment 225 to the top portion 210 such that the cavity portion may hang in front of the seat 410. The method continues by adjusting at least one seat engaging member 211*a* or 211*b* to engage the seat such that the top portion 210 is prevented from moving away from the seat. The method may further include adjusting at least one seat engaging member 211*a* and 211*b* by rotating the at least one seat engaging member from a storage position to an engagement position.

The embodiment of FIGS. 2-4 may be well suited for engaging a stadium seat such as those typically having a biased, rotatable seat portion that may be rotated down for sitting and rotated up for cleaning the space below the seat. Further, the seat caddy 200 may also be well suited for engaging a lawn chair having a collapsible seat portion. Other embodiments, such as the one shown in FIG. 4 may be well-suited for engaging a bleacher or bench seat 410.

The various designs described in FIGS. 2-4 above provide for at least two options for seat caddies. One such option is a thin and compact cushion with a geometry and shape roughly the same size as the bag as shown. Such a design provides less comfort, but it is more compact and provides a support for suspending the storage cavity.

According to a second option for the seat caddy, a thicker and more robust cushion covers a larger seating area. Such a design is not as compact, but provides more comfort as well as a support for suspending the storage cavity. The storage cavity may be manufactured in a number of different sizes including 3", 4" and 5" widths, depending on one's storage requirements.

While the invention is susceptible to various modifications and alternative constructions, certain illustrated embodiments thereof are shown in the drawings and have been described above in detail. It should be understood, however, that there is no intention to limit the invention to the specific forms disclosed, but on the contrary, the intention is to cover all modifications, alternative constructions, and equivalents falling within the spirit and scope of the invention.

What is claimed is:

1. A seat caddy, comprising:

a top portion operable to engage a bench, the top portion having a front side and a rear side such that when engaged with the bench, the front side aligns with a front side of the bench and the rear side aligns with a rear side of the bench;

at least one rigid bench engagement member attached to the top portion near the rear side such that the bench engagement member comprises a vertical configuration to couple with, and is configured to engage the bench to oppose an upward rotation of the top portion away from the bench in the presence of a moment force at the front side of the top portion, the seat engagement member being rotatably attached to the bottom side of the top portion such that the seat engagement member assumes a horizontal orientation when the seat engagement member rotates to a storage position being parallel with the bottom side of the top portion; and a storage cavity removably attached to the top portion near the front side such that the storage cavity hangs from the top portion in front of the bench and such that the storage cavity generates a moment force at the front side of the top portion causing the bench engagement member to engage the bench; and at least one securing mechanism projecting from the bottom side of the top portion for engaging each seat engagement member when the seat engagement member is rotated to the storage position wherein the securing mechanism comprises a plastic engagement device with a concave slot facing away from the bottom side of the top portion, the securing mechanism securely holding the seat engagement member in the storage position when the seat engagement member rotates to pass through the opening of the securing mechanism, and the seat engagement member being releasably detachable from the securing mechanism when rotated into the vertical configuration to hook around the seat.

2. The seat caddy of claim 1 wherein the top portion further comprises a cushion surface suitable for seating a human.

3. The seat caddy of claim 2, wherein the top portion comprises a material selected from the group comprising: leather, vinyl, cloth, plastic, composite, fabric, and canvas.

4. The seat caddy of claim 1, wherein the bench engaging member is rotatably attached to the top portion such that the bench engaging member is operable to be rotated to a storage position while still attached to the top portion when not engaged with a bench.

5. The seat caddy of claim 4, wherein the top portion further comprises a securing mechanism for engaging the rotatably attached bench-engaging member when the bench-engaging member is rotated to a storage position.

6. The seat caddy of claim 4 further comprising a carry strap removably attached to the top portion.

7. The seat caddy of claim 1 wherein the storage cavity comprises a movable flap opening such that the movable flap opening may be secured in a closed position enclosing the storage cavity and secured in an open position exposing the storage cavity.

8. The seat caddy of claim 7 wherein the storage cavity is insulated for maintaining a temperature inside the storage cavity.

9. The seat caddy of claim 1 further comprising a manipulation device for removing the storage cavity, the manipulation device selected from the group comprising: a push-button latch, a hook and latch attachment, a tie-down, a pressure-ring latch, a snap, and a zip-latch.

10. The seat caddy of claim 1, further comprising a seat back member rotatably attached to the rear side of the top portion such that the seat back may be rotated to a vertical position to support the back of a person seated in the seat caddy and rotated to a horizontal position parallel with the top portion for storage while the seat caddy is engaged with a bench.

11. The seat caddy of claim 1 comprising a first and second bench engaging member;

and a first and second securing mechanism;

wherein the first and second bench engaging member are rotatably attached to the top portion such that the first and second bench engaging member are operable to be rotated to a storage position while still attached to the top portion when not engaged with a bench;

wherein the first securing mechanism engages the rotatably attached first bench engaging member when the first bench engaging member is rotated to a storage position; and wherein the second securing mechanism engages the rotatably attached second bench engaging member when the second bench engaging member is rotated to a storage position.

12. An apparatus, comprising:

a seat suitable for supporting a human in a sitting position; and a seat caddy engaged with the seat, the seat caddy comprising:

a top portion operable to engage the seat, the top portion having a front side and a rear side such that when engaged with the seat, the front side aligns with a front side of the seat and the rear side aligns with a rear side of the seat;

at least one rigid seat engagement member attached to the top portion near the rear side such that the seat engagement member has a vertical configuration to hook around the seat to oppose an upward rotation of the top portion away from the seat in the presence of a moment force at the front side of the top portion, the seat engagement member being rotatably attached to the bottom side of the top portion such that the seat engaging member has a horizontal configuration where the seat engagement member rotates to a storage position being parallel with the bottom side of the top portion;

a storage cavity removably attached to the top portion near the front side such that storage cavity hangs from the top portion in front of the seat and such that the storage cavity generates a moment force at the front side of the top portion causing the bench engagement member to engage the bench; and at least one securing mechanism projecting from the bottom side of the top portion for engaging each seat engagement member when the seat engagement member is rotated to the storage position, wherein the securing mechanism is a U-shaped plastic engagement device and has an opening facing away from the bottom side of the top portion, the securing mechanism securely holding the seat engagement member in the storage position when the seat engagement member rotates to pass through the opening of the securing mechanism, and the seat engagement member being releasably detachable from the securing mechanism when rotated into the vertical configuration to hook around the seat.

13. The apparatus of claim 12 wherein the seat comprises a bench seat having a suitable length for multiple humans to sit, the bench suitable for engaging the seat caddy.

14. A method for attaching a seat caddy to a seat, the method comprising:

engaging an adjustable seat caddy with a seat, such that a top portion of the seat caddy rests on the seat and a cavity portion is supported by an attachment to the top portion such that the cavity hangs in front of the seat;

disengaging at least one seat engaging member from a plastic storage slot of a securing mechanism, the securing mechanism extending from the bottom side of the top portion and configured to securely hold the engaging member in a storage position parallel with the bottom side of the top portion when the engaging member is within the slot;

rotating the at least one seat engaging member into a vertical engagement position, the engaging member comprising a vertical body to couple to the seat; and adjusting at least one seat engaging member positioned at a side opposite the cavity portion such that moment force due to gravity present at the front of the seat causes the at least one seat engaging member to engage the seat.

15. The method of claim 14 wherein the adjusting at least one seat engaging member comprises rotating the at least one seat engaging member about an axis existing in a plane perpendicular from the direction of the moment force from a storage position to an engagement position.

* * * * *